US010607547B2

(12) United States Patent
Yang et al.

(10) Patent No.: US 10,607,547 B2
(45) Date of Patent: Mar. 31, 2020

(54) DISPLAY APPARATUS AND METHOD OF DRIVING THE SAME

(71) Applicant: Samsung Display Co., Ltd., Yongin-Si, Gyeonggi-Do (KR)

(72) Inventors: Gunwoo Yang, Seoul (KR); Cholho Kim, Suwon-si (KR); Wonjun Lee, Hwaseong-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 16/205,499

(22) Filed: Nov. 30, 2018

(65) Prior Publication Data

US 2019/0172396 A1 Jun. 6, 2019

(30) Foreign Application Priority Data

Dec. 6, 2017 (KR) ..... 10-2017-0166890

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/043* (2013.01); *G09G 2300/0819* (2013.01); *G09G 2300/0852* (2013.01); *G09G 2300/0876* (2013.01); *G09G 2310/08* (2013.01); *G09G 2320/0214* (2013.01); *G09G 2320/045* (2013.01)

(58) Field of Classification Search
CPC ..... G09G 3/3233; G09G 3/3258; G09G 2300/043; G09G 2300/0819; G09G 2300/0852; G09G 2300/0876; G09G 2310/08; G09G 2320/0214; G09G 2320/045
See application file for complete search history.

(56) References Cited

U.S. PATENT DOCUMENTS

2006/0044244 A1* 3/2006 Numao ..... G09G 3/3233 345/92
2013/0120337 A1* 5/2013 Guo ..... G09G 3/3208 345/211
2018/0197475 A1* 7/2018 Yang ..... H01L 27/3265

FOREIGN PATENT DOCUMENTS

KR 1020170078891 A 7/2017
KR 1020180082662 A 7/2018

* cited by examiner

*Primary Examiner* — Michael Pervan
(74) *Attorney, Agent, or Firm* — Cantor Colburn LLP

(57) ABSTRACT

A display apparatus includes a voltage generator which generates an initial controlling signal which comprises a high voltage, a middle voltage and a low voltage, where the initial controlling signal swings from the middle voltage to the low voltage after a plurality of gate signals is simultaneously dropped from a high voltage to a low voltage thereof.

20 Claims, 12 Drawing Sheets

<a-PERIOD>

<b-PERIOD>

<c-PERIOD>

<d-PERIOD>

<e-PERIOD>

<b-PERIOD>

<c-PERIOD>

COMPARATIVE EXEMPLARY EMBODIMENT

DISPLAY APPARATUS AND METHOD OF DRIVING THE SAME

This application claims priority to Korean Patent Application No. 10-2017-0166890, filed on Dec. 6, 2017, and all the benefits accruing therefrom under 35 U.S.C. § 119, the content of which in its entirety is hereby incorporated by reference.

BACKGROUND

1. Field of the Invention

Exemplary embodiments of the inventive concept relate to a display apparatus and a method of driving the display apparatus. More particularly, exemplary embodiments of the inventive concept relate to a display apparatus for improving a display quality and a method of driving the display apparatus.

2. Description of the Related Art

Various flat panel display devices that have weight and size advantages over conventional display devices such as Cathode Ray Tube ("CRT") have been developed. An example of the flat panel display device include a liquid crystal display ("LCD") device, a field emission display ("FED") device, a plasma display panel ("PDP") device, and an organic light emitting display ("OLED") device.

The OLED device has advantages such as a rapid response speed and low power consumption because the OLED device uses an organic light emitting diode that emits a light based on recombination of electrons and holes.

SUMMARY

Exemplary embodiments of the inventive concept provide a display apparatus for improving a display quality.

Exemplary embodiments of the inventive concept provide a method of driving the display apparatus.

According to an exemplary embodiment of the inventive concept, a display apparatus includes a gate driver which sequentially outputs a plurality of gate signals to a plurality of gate lines, a display part comprising a pixel which comprises a first capacitor connected between a first voltage line receiving an initialization driving signal and a first node, a first transistor which comprises a control electrode connected to the first node, a first electrode connected to a second voltage line receiving a first power source signal and a second electrode connected to a second node, an organic light emitting diode which comprises an anode electrode connected to the second node and a cathode electrode receiving a second power source signal, a second capacitor connected between a data line and the second node, a second transistor which comprises a control electrode connected to an n-th gate line of the plurality of gate lines, a first electrode connected to the first node and a second electrode connected to the second node, where 'n' is a natural number, and a third transistor which comprises a control electrode connected to a third voltage line receiving an initialization controlling signal, a first electrode connected to the first voltage line and a second electrode connected to the second node, and a voltage generator which generates the initial driving signal which comprises a high voltage, a middle voltage and a low voltage, where the initial driving signal swings from the middle voltage to the low voltage thereof after the plurality of gate signals is simultaneously dropped from a high voltage to a low voltage of the plurality of gate signals.

In an exemplary embodiment, during a first period of a frame period, the first voltage line may receive the middle voltage of the initial driving signal, the second voltage line may receive a high voltage of the first power source signal, the plurality of gate lines may simultaneously receive the high voltage of the plurality of gate signals and the third voltage line may receive a high voltage of the initial controlling signal.

In an exemplary embodiment, during a second period of the frame period, the first voltage line may receive the middle voltage of the initial driving signal, the second voltage line may receive a low voltage of the first power source signal, the plurality of gate lines may simultaneously receive the high voltage of the plurality of gate signals and the third voltage line may receive a low voltage of the initial controlling signal.

In an exemplary embodiment, during a third period of the frame period, the first voltage line may receive the initial driving signal swinging from the middle voltage to the low voltage thereof, the second voltage line may receive the low voltage of the first power source signal, the plurality of gate lines may simultaneously receive the low voltage of the plurality of gate signals and the third voltage line may receive the low voltage of the initial controlling signal.

In an exemplary embodiment, the high voltage of the initial driving signal may have a positive voltage, and the middle and low voltages of the initial driving signal may have negative voltages.

In an exemplary embodiment, during a first period of a frame period, the first voltage line may receive the low voltage of the initial driving signal, the second voltage line may receive a high voltage of the first power source signal, the plurality of gate lines may simultaneously receive the high voltage of the plurality of gate signals and the third voltage line may receive a high voltage of the initial controlling signal.

In an exemplary embodiment, during a second period of the frame period, the first voltage line may receive the initial driving signal swinging from the low voltage to the middle voltage thereof, the second voltage line may receive a low voltage of the first power source signal, the plurality of gate lines may simultaneously receive the high voltage of the plurality of gate signals and the third voltage line may receive a low voltage of the initial controlling signal.

In an exemplary embodiment, during a third period of the frame period, the first voltage line may receive the initial driving signal swinging from the middle voltage to the low voltage thereof, the second voltage line may receive the low voltage of the first power source signal, the plurality of gate lines may simultaneously receive a low voltage of the plurality of gate signals and the third voltage line may receive the low voltage of the initial controlling signal.

In an exemplary embodiment, the high and middle voltages of the initial driving signal may have positive voltages and the low voltage of the initial driving signal may have a negative voltage.

In an exemplary embodiment, wherein the low voltage of the initial driving signal may be about −6V.

In an exemplary embodiment, during a fourth period of the frame period, the first voltage line may receive the low voltage of the initial driving signal, the n-th gate line may receive the high voltage of an n-th gate signal of the plurality of gate signals, the third voltage line may receive the low voltage of the initial controlling signal and the data line may receive a data voltage corresponding to the pixel.

In an exemplary embodiment, during a period when the n-th gate line receives the high voltage of the n-th gate signal, the first and second capacitors may be connected to each other in series, the data voltage may be divided by the first and second capacitors and a divided voltage of the data voltage may be applied to the first node.

In an exemplary embodiment, during the fourth period of the frame period, the second voltage line may receive a middle voltage between the high voltage and the low voltage of the first power source signal.

In an exemplary embodiment, during a fifth period of the frame period, the first voltage line may receive the high voltage of the initial driving signal, the second voltage line may receive a high voltage of the first power source signal, the third voltage line may receive a low voltage of the initial controlling signal, the plurality of gate lines simultaneously may receive the low voltage of the plurality of gate signals, and a driving current corresponding to a divided voltage, applied to the first node, of a data voltage provided from the data line during a fourth period of the frame period may flow through the organic light emitting diode.

According to an exemplary embodiment of the inventive concept, there is provided a method of driving a display apparatus comprising a pixel which comprises a first capacitor connected between a first voltage line receiving an initialization driving signal and a first node, a first transistor which comprises a control electrode connected to the first node, a first electrode connected to a second voltage line receiving a first power source signal and a second electrode connected to a second node, an organic light emitting diode which comprises an anode electrode connected to the second node and a cathode electrode receiving a second power source signal, a second capacitor connected between a data line and the second node, a second transistor which comprises a control electrode connected to an n-th gate line of a plurality of gate lines, a first electrode connected to the first node and a second electrode connected to the second node, and a third transistor which comprises a control electrode connected to a third voltage line receiving an initialization controlling signal, a first electrode connected to the first voltage line and a second electrode connected to the second node, where 'n' is a natural number. The method may include generating an initial driving signal comprising one of a high voltage, a middle voltage and a low voltage at once, initializing an anode electrode of the organic light emitting diode connected to the second electrode of the first transistor using the initial driving signal received from the first voltage line, applying a low voltage of a first power source signal to the first electrode of the first transistor such that the first transistor is diode-coupled and a threshold voltage of the first transistor is compensated, receiving the initial driving signal which swings from the middle voltage to the low voltage after a plurality of gate signals applied to the plurality of gate lines is simultaneously dropped from a high voltage to a low voltage thereof, (e) applying a voltage divided by the first and second capacitors from a data voltage received through the data line to the first node during a period when only the n-th gate line of the plurality of gate lines receives a high voltage of the plurality of gate signals, and (f) emitting light by the organic light emitting diode based on the divided voltage applied to the first node in response to the initial driving signal received from the first voltage line.

In an exemplary embodiment, the first voltage line may receive the middle voltage of the initial driving signal in initializing the anode electrode of the organic light emitting diode and applying the low voltage of the first power source signal, the low voltage of the initial driving signal in applying the voltage divided by the first and second capacitors, and the high voltage of the initial driving signal in emitting light by the organic light emitting diode.

In an exemplary embodiment, the high voltage of the initial driving signal may have a positive voltage, and the middle and low voltages of the initial driving signal may have negative voltages.

In an exemplary embodiment, the first voltage line may receive the low voltage of the initial driving signal in initializing an anode electrode of the organic light emitting diode and applying the voltage divided by the first and second capacitors, and the high voltage of the initial driving signal in emitting light by the organic light emitting diode.

In an exemplary embodiment, the high and middle voltages of the initial driving signal may have positive voltages and the low voltage of the initial driving signal may have a negative voltage.

In an exemplary embodiment, the second voltage line may receive a high voltage of the first power source signal in initializing an anode electrode of the organic light emitting diode and emitting light by the organic light emitting diode, a low voltage of the first power source signal in applying the low voltage of the first power source signal and receiving the initial driving signal, and a middle voltage between the high and low voltages of the first power source signal in applying the voltage divided by the first and second capacitors.

According to the inventive concept, in the pixel circuit including an organic light emitting diode, three transistors and two capacitors which drive the organic light emitting diode, the ripple of the transistor is controlled and thus the display defects such as the crosstalk by the ripple of the transistor may be avoided.

BRIEF DESCRIPTION OF THE DRAWINGS

The above and other features and advantages of the inventive concept will become more apparent by describing in detailed exemplary embodiments thereof with reference to the accompanying drawings, in which.

DETAILED DESCRIPTION

It will be understood that, although the terms "first," "second," "third", etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof "About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10% or 5% of the stated value.

Hereinafter, the inventive concept will be explained in detail with reference to the accompanying drawings.

Figure 1:
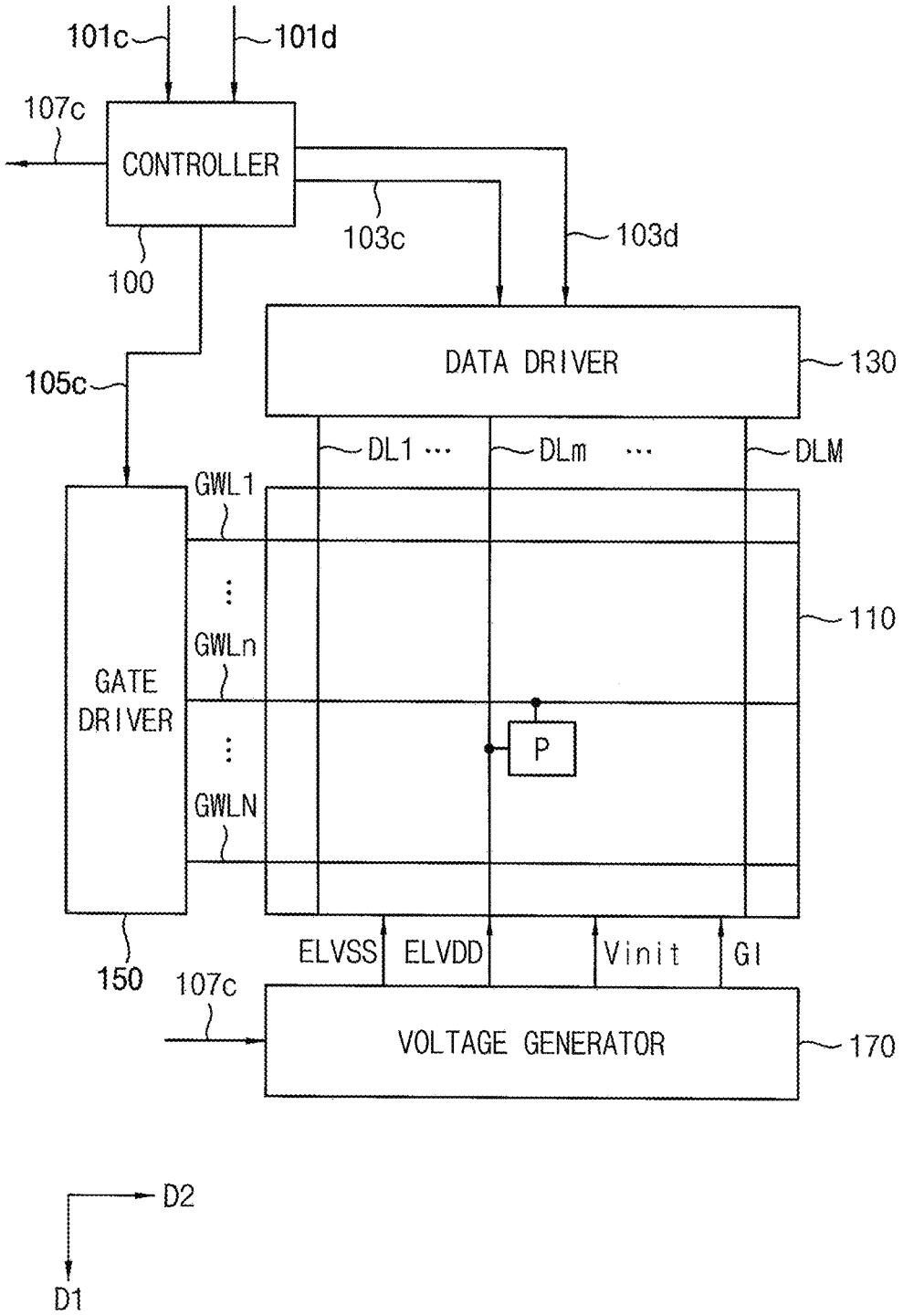
FIG. 1 is a block diagram illustrating an exemplary embodiment of a display apparatus according to the invention.

FIG. 1 is a block diagram illustrating an exemplary embodiment of a display apparatus according to the invention.

Referring to FIG. 1, the display apparatus may include a controller 100, a display part 110, a data driver 130, a gate driver 150 and a voltage generator 170.

The controller 100 may be configured to generally control the display apparatus to display an image on the display part 110. The controller 100 is configured to receive a control signal 101*c* and image data 101*d*. The controller 100 is configured to provide the data driver 130 with a data control signal 103*c* and the image data 103*d* in order to drive the data driver 130. The controller 100 is configured to provide the gate driver 150 with a scan control signal 105*c* in order to drive the gate driver 150. The controller 100 is configured to provide the voltage generator 170 with a voltage control signal 107*c* in order to drive the voltage generator 170.

The controller 100 is configured to drive the display part 110 during a frame period which may include an initializing period, a compensating period, a ripple-controlling period, a data-programming period and a light-emitting period.

The display part 110 may include a plurality of pixels P, a plurality of data lines DL1, . . . , DLm, . . . , DLM, a plurality of gate lines GWL1, . . . , GWLn, . . . , GWLN, a first voltage line, a second voltage line and a third voltage line (wherein, 'n', 'N', 'm' and 'M' are natural numbers, n is the same with or less than N, and m is the same with or less than M).

Each of the plurality of pixels P may include an organic light emitting diode and three transistors and two capacitors, which drive the organic light emitting diode.

The data lines DL1, . . . , DLm, . . . , DLM may extend in a first direction D1 respectively and be arranged in a second direction D2 crossing the first direction D1. Each data line is configured to transfer a data voltage to the pixels P in the same column of the pixels which are arranged in the first direction D1.

The gate lines GWL1, . . . , GWLn, . . . , GWLN may extend in the second direction D2 and be arranged in the first direction D1. Each gate line is configured to transfer a gate signal to the pixels P in the same row of the pixels which are arranged in the second direction D2. During the data-programming period, the gate lines GWL1, . . . , GWLn, . . . , GWLN may be configured to sequentially transfer a plurality of gate signals to a plurality of rows of pixels.

The first voltage line may transfer an initial driving signal Vinit to the plurality of pixels P.

The second voltage line may transfer a first power source signal ELVDD to the plurality of pixels P.

The third voltage line may transfer an initial controlling signal GI to the plurality of pixels P.

The data driver 130 is configured to provide the data lines DL1, . . . , DLm, . . . , DLM with the data voltages corresponding to the image data during the data-programming period of the frame period.

In addition, the data driver 130 is configured to provide the data lines DL1, . . . , DLm, . . . , DLM with a reference voltage. The reference voltage may be equal to or lower than a voltage corresponding to a black grayscale.

The gate driver 150 is configured to sequentially provide the gate lines GWL1, . . . , GWLn, . . . , GWLN with the gate signal. The gate signal may have a high voltage and a low voltage.

The voltage generator 170 is configured to generate the initial driving signal Vinit, the first power source signal ELVDD, a second power source signal ELVSS and the initial controlling signal GI.

The initial driving signal Vinit is applied to the first voltage line and may have a high voltage, a middle voltage and a low voltage.

The first power source signal ELVDD is applied to the second voltage line and has a high voltage, a middle voltage and a low voltage.

The second power source signal ELVSS is applied to a common electrode of the pixels P, that is a cathode electrode of an organic light emitting diode and may have a low voltage of a normal power source signal.

The initial controlling signal GI is applied to the third voltage line GIL and may have a high voltage and a low voltage.

The gate driver 150 is configured to sequentially provide a high voltage of the gate signal with the gate lines GWL1, . . . , GWLn, . . . , GWLN.

Figure 2:
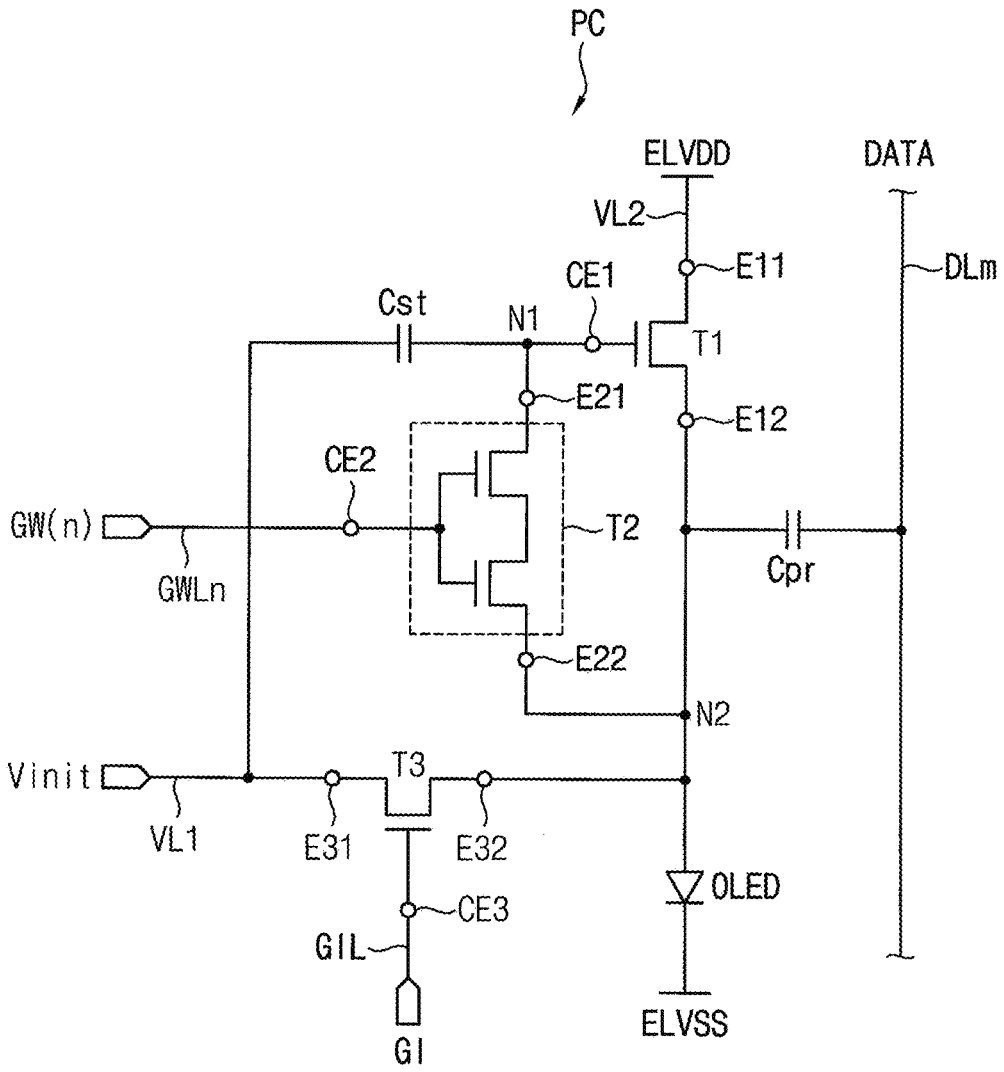
FIG. 2 is a pixel circuit diagram illustrating an exemplary embodiment of a pixel according to the invention.

FIG. 2 is a pixel circuit diagram illustrating an exemplary embodiment of a pixel according to the invention.

Referring to FIGS. 1 and 2, the pixel circuit PC may be included in the pixel P of the display part 110.

The pixel circuit PC may include an organic light emitting diode OLED, and three transistors and two capacitors which drives the organic light emitting diode OLED. The pixel circuit PC may include a first transistor T1, a second transistor T2, a third transistor T3, a first capacitor Cst, a second capacitor Cpr and an organic light emitting diode OLED.

According to an exemplary embodiment, each of the first, second and third transistors T1, T2 and T3 may be an N-type transistor. The N-type transistor may turn on when a high voltage is applied to a control electrode (i.e., gate electrode) and turn off when a low voltage is applied to the control electrode. According to an exemplary embodiment, the high voltage may be a turn-on voltage of the N-type transistor and the low voltage may be a turn-off voltage of the N-type transistor.

The first transistor T1 may include a control electrode CE1 connected to a first node N1, a first electrode E11 connected to a second voltage line VL2 and a second electrode E12 connected to a second node N2. The second voltage line VL2 is configured to receive the first power source signal ELVDD.

The first power source signal ELVDD may have a high voltage which is a voltage of a normal positive power source signal, a low voltage which is a predetermined low voltage for driving the pixel circuit P and a middle voltage which is a predetermined middle voltage for reducing a leakage current of a transistor.

The second transistor T2 may include a control electrode CE2 connected to the n-th gate line GWLn, a first electrode E21 connected to the first node N1 and a second electrode E22 connected to the second node N2. The n-th gate line GWLn is configured to receive an n-th gate signal GW(n). The n-th gate signal GW(n) may have a high voltage which turns on the second transistor T2 and a low voltage which turns off the second transistor T2. The second transistor T2 may include a plurality of transistors which are connected to each other in series as shown in FIG. 2.

The third transistor T3 may include a control electrode CE3 connected to the third voltage line GIL, a first electrode E31 connected to the first voltage line VL1 and a second electrode E32 connected to the second node N2. The first voltage line VL1 is configured to receive an initial driving signal Vinit.

The initial driving signal Vinit may have high, middle and low voltages which are predetermined voltages to drive the pixel circuit PC. More specifically, the high voltage of the initial driving signal Vinit may be predetermined to have a voltage level for turning-on the transistor. The middle voltage and the low voltage of the initial driving signal Vinit may be predetermined to have voltage levels for initializing the anode electrode of the organic light emitting diode OLED and for reducing the leakage current of the transistor, respectively.

The high voltage initH, the middle voltage initM and the low voltage initL of the initial driving signal Vinit may be the same relationship as initH>0>initM>initL.

Alternatively, the high voltage initH, the middle voltage initM and the low voltage initL of the initial driving signal Vinit may be the same relationship as initH>initM>0>initL.

The third voltage line GIL is configured to receive the initial controlling signal GI. The initial controlling signal GI may have a high voltage which turns on the third transistor T3 and a low voltage which turns off the third transistor T3.

The first capacitor Cst may be connected between the first voltage line VL1 and the first node N1. The first capacitor Cst may store a node voltage applied to the first node N1.

The second capacitor Cpr may be connected between the second node N2 and m-th data line DLm. The second capacitor Cpr may store the data voltage DATA applied to the m-th data line DLm.

The first and second capacitors Cst and Cpr may be connected by the second transistor T2 in series. The data voltage DATA applied to the m-th data line DLm may be divided by a voltage division ratio of the first and second capacitors Cst and Cpr connected in series when the second transistor T2 is turned on, and the divided data voltage may be applied to the first node N1.

The organic light emitting diode OLED may include an anode electrode connected to the second node N2 and a cathode electrode which receives the second power source signal ELVSS.

When the transistor T1 is turned on, a driving current corresponding to the data voltage applied to the first node N1 may flow through the organic light emitting diode OLED and thus, the organic light emitting diode OLED may emit the light.

Figure 3:
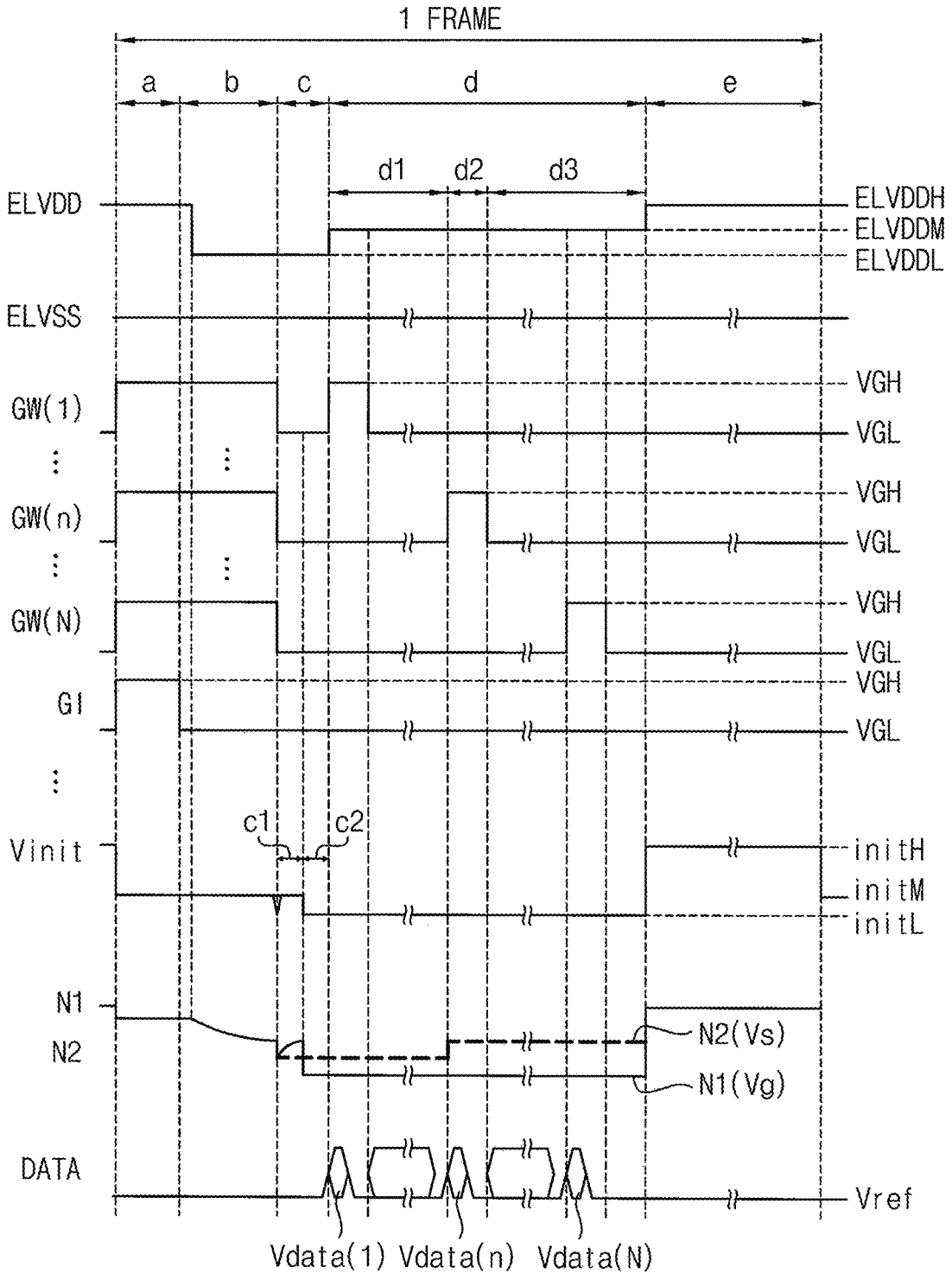
FIG. 3 is a waveform diagram illustrating an exemplary embodiment of a method of driving a pixel circuit according to the invention.

FIG. 3 is a waveform diagram illustrating an exemplary embodiment of a method of driving a pixel circuit according to the invention.

Referring to FIGS. 1, 2 and 3, the display part 110 may receive a plurality of input signals. The plurality of input signal may include the initial driving signal Vinit applied to the first voltage line VL1, the first power source signal ELVDD applied to the second voltage line VL2, the initial controlling signal GI applied to the third voltage line GIL, a plurality of gate signals GW(1), . . . , GW(n), . . . , GW(N) applied to the plurality of gate lines GWL1, . . . , GWLn, . . . , GWLN, data voltages DATA applied to the plurality of data lines and the second power source signal ELVSS applied to the cathode electrode of the organic light emitting diode OLED. The data voltage DATA may be referred to as a data voltage applied to the m-th data line DLm of the plurality of data lines DL1, . . . , DLm, . . . , DLM.

According to an exemplary embodiment, the initial driving signal Vinit may have the high voltage VintH, the middle voltage VintM and the low voltage VintL, where the voltages have such relationships as VintH>0>VintM>VintL.

One frame period may include a first period 'a' during which the anode electrode of the organic light emitting diode OLED is initialized ("an initializing period"), a second period 'b' during which a threshold voltage of the first transistor T1 is compensated ("a compensating period"), a third period 'c' during which a ripple of the first node N1 is controlled ("a ripple-controlling period"), a fourth period 'd' during which the data voltage is applied to the pixel ("a data-programming period") and a fifth period e' during which the organic light emitting diode OLED emits the light ("a light-emitting period").

Referring to the first period 'a', the first voltage line VL1 receives the middle voltage initM of the initial driving signal Vinit. In an exemplary embodiment, for example, the middle voltage initM of the initial driving signal Vinit may be predetermined to about −2.2 V.

The second voltage line VL2 receives a high voltage ELVDDH of the first power source signal ELVDD. In an exemplary embodiment, for example, the high voltage ELVDDH of the first power source signal ELVDD may be predetermined to about 7 V.

The third voltage line GIL receives a high voltage VGH of the initial controlling signal GI. The high voltage VGH of the initial controlling signal GI may have a voltage level for turning on the third transistor T3. In an exemplary embodiment, for example, the high voltage VGH of the initial controlling signal GI may be predetermined to about 8 V.

In an exemplary embodiment, for example, the high voltage ELVDDH of the first power source signal ELVDD may be predetermined to about 7 V, the low voltage ELVDDL of the first power source signal ELVDD may be predetermined to about −7 V and the second power source signal ELVSS may be predetermined to about 0 V.

The plurality of gate lines GWL1, . . . , GWLn, . . . , GWLN may simultaneously receive the high voltages VGH of the plurality of gate signals GW(1), . . . , GW(n), . . . , GW(N). The high voltage VGH of the gate signal may have a voltage level for turning on the second transistor T2. In an exemplary embodiment, for example, the high voltage VGH of the gate signal may be predetermined to about 8 V.

The plurality of data lines DL1, . . . , DLm, . . . , DLM may receive a reference voltage Vref. The reference voltage Vref may be equal to or lower than the lowest voltage in a voltage range of the data voltage.

During the first period 'a', the anode electrodes of the organic light emitting diodes OLED in all the pixels P may be initialized by the middle voltage initM of the initial driving signal Vinit, simultaneously.

Referring to the second period 'b', the first voltage line VL1 is configured to receive the middle voltage initM of the initial driving signal Vinit.

The second voltage line VL2 is configured to receive a low voltage ELVDDL of the first power source signal ELVDD. In an exemplary embodiment, for example, the low voltage ELVDDL of the first power source signal ELVDD may be predetermined to about −5 V.

The third voltage line GIL is configured to receive a low voltage VGL of the initial controlling signal GI. The low voltage VGL of the initial controlling signal GI may have a voltage level for turning off the third transistor T3. In an exemplary embodiment, for example, the low voltage VGL of the initial controlling signal GI may be predetermined to about −8 V.

The plurality of gate lines GWL1, . . . , GWLn, . . . , GWLN is configured to simultaneously receive high voltages VGH of the plurality of gate signals GW(1), . . . , GW(n), . . . , GW(N) as in the first period 'a'.

The plurality of data lines DL1, . . . , DLm, . . . , DLM is configured to receive the reference voltage Vref as in the first period 'a'.

During the second period 'b', a threshold compensation voltage ELVDDL+Vth which is a sum of the low voltage ELVDDL of the first power source signal ELVDD and the threshold voltage Vth of the first transistor T1 is applied to the control electrode of the first transistor T1, and thus the threshold voltages of the first transistors T1 in all the pixels P may be simultaneously compensated.

Referring to the third period 'c', the third period 'c' may include an early period 'c1' and a latter period c2'. The first voltage line VL1 receives the middle voltage initM of the initial driving signal Vinit during the early period 'c1' and the low voltage initL of the initial driving signal Vinit during the latter period 'c2'. The low voltage initL of the initial driving signal Vinit may be predetermined to a voltage level for turning off the first transistor T1. In an exemplary embodiment, for example, the low voltage initL of the initial driving signal Vinit may be predetermined to be less than about −6 V.

The second voltage line VL2 receives the low voltage ELVDDL of the first power source signal ELVDD. In an exemplary embodiment, for example, the low voltage ELVDDL of the first power source signal ELVDD may be predetermined to about −5 V.

The third voltage line GIL receives the low voltage VGL of the initial controlling signal GI. The low voltage VGL of the initial controlling signal GI may be predetermined to a voltage level for turning off the third transistor T3. In an exemplary embodiment, for example, the low voltage VGL of the initial controlling signal GI may be predetermined to about −8 V.

The plurality of gate lines GWL1, . . . , GWLn, . . . , GWLN simultaneously receives the low voltage VGL of the plurality of gate signals GW(1), . . . , GW(n), . . . , GW(N).

The plurality of data lines DL1, . . . , DLm, . . . , DLM receives the reference voltage Vref.

Referring to the early period 'c1', a first ripple occurs on the initial driving signal Vinit by coupling with the gate signal when the plurality of gate signals GW(1), . . . , GW(n), . . . , GW(N) is simultaneously dropped from the high voltage VGH to low voltage VGL. Thus, a second ripple occurs at a voltage applied to the first node N1 by the first ripple of the initial driving signal Vinit.

Referring to the latter period 'c2', the low voltage initL lower than the middle voltage initM of the initial driving signal Vinit is applied to the first voltage line VL1, and thus the voltage applied to the first node N1 may be dropped to a voltage lower than a voltage applied to the second node N2 based on the low voltage initL of the initial driving signal Vinit. During from the latter period 'c2' to the fourth period which is the data-programming period, the first voltage line VL1 receives the low voltage initL of the initial driving signal Vinit, and thus the voltage applied to the first node N1 may be maintained to be the voltage lower than the voltage applied to the second node N2.

Referring to the fourth period 'd', the fourth period d may include a first holding period 'd1', a writing period 'd2' and a second holding period 'd3'.

Referring to the pixel circuit PC of the n-th row of pixels shown in FIG. 2, during the first holding period 'd1', the first voltage line VL1 receives the low voltage initL of the initial driving signal Vinit, the second voltage line VL2 receives the middle voltage ELVDDM of the first power source signal ELVDD, the third voltage line GIL receives the low voltage VGL of the initial controlling signal GI. The n-th gate line GWLn receives the low voltage VGL of the n-th gate signal GW(n), and the m-th data line DLm receives data voltages Vdata(1), . . . , Vdata(n−1) corresponding to first to (n−1)-th row of pixels During the first holding period 'd1', a voltage Vg applied to the first node N1 may be maintained to be a voltage lower than a voltage Vs applied to the second node N2 by controlling the second ripple occurred in the third period 'c'. Thus, during the first holding period 'd1', a gate/source voltage of the first transistor T1 having a value of the voltage Vg minus the voltage Vs may be maintained to be a voltage being lower than 0V, and thus the leakage current of the first transistor T1 may be avoided. Here, the gate/source voltage of the first transistor T1 is a voltage difference between the voltage of the first node N1 and the voltage of the second node N2.

During the writing period 'd2', the first voltage line VL1 receives the low voltage initL of the initial driving signal Vinit, the second voltage line VL2 receives the middle voltage ELVDDM of the first power source signal ELVDD, and the n-th gate line GWLn receives the high voltage VGH of the n-th gate signal GW(n). The m-th data line DLm receives the data voltage Vdata(n) corresponding to the n-th row of pixels.

The second transistor T2 is turned on and then the first and second capacitors Cst and Cpr are connected to each other in series. The data voltage DATA applied to the m-th data line DLm is divided by the first and second capacitors Cst and Cpr, and the divided data voltage is applied to the first node N1 and is stored at the first capacitor Cst.

The divided data voltage applied to the first node N1 is maintained during the second holding period 'd3'. During the second holding period 'd3', the n-th gate line GWLn receives the low voltage VGL of the n-th gate signal GW(n). The third voltage line GIL receives the low voltage of the initial controlling signal GI.

Referring to the fifth period 'e', the second voltage line VL2 receives the high voltage ELVDDH of the first power source signal ELVDD.

The first voltage line VL1 receives the high voltage initH of the initial driving signal Vinit. The high voltage initH of the initial driving signal Vinit may have a voltage level for turning on the first transistor T1. The high voltage initH of the initial driving signal Vinit may be predetermined to about 5 V.

The second voltage line VL2 receives the high voltage ELVDDH of the first power source signal ELVDD and the third voltage line GIL receives the low voltage VGL of the initial controlling signal GI.

The plurality of gate lines GWL1, . . . , GWLn, . . . , GWLN simultaneously receives the low voltage VGL of the plurality of gate signals GW(1), . . . , GW(n), . . . , GW(N).

The third voltage line GIL receives the low voltage VGL of the initial controlling signal GI.

During the fifth period 'e', a driving current corresponding to the data voltage applied to the first node N1 may be provided to the organic light emitting diode OLED and the organic light emitting diode OLED may emit the light. Thus, the organic light emitting diodes OLED in all the pixels P may simultaneously emit the light.

According to an exemplary embodiment, the method of driving the pixel circuit may include the ripple-controlling period 'c' for controlling a gate ripple of the first transistor T1 between the compensating period 'b' and the data-programming period 'd', and thus display defects such as a crosstalk may be avoided.

Figure 4:
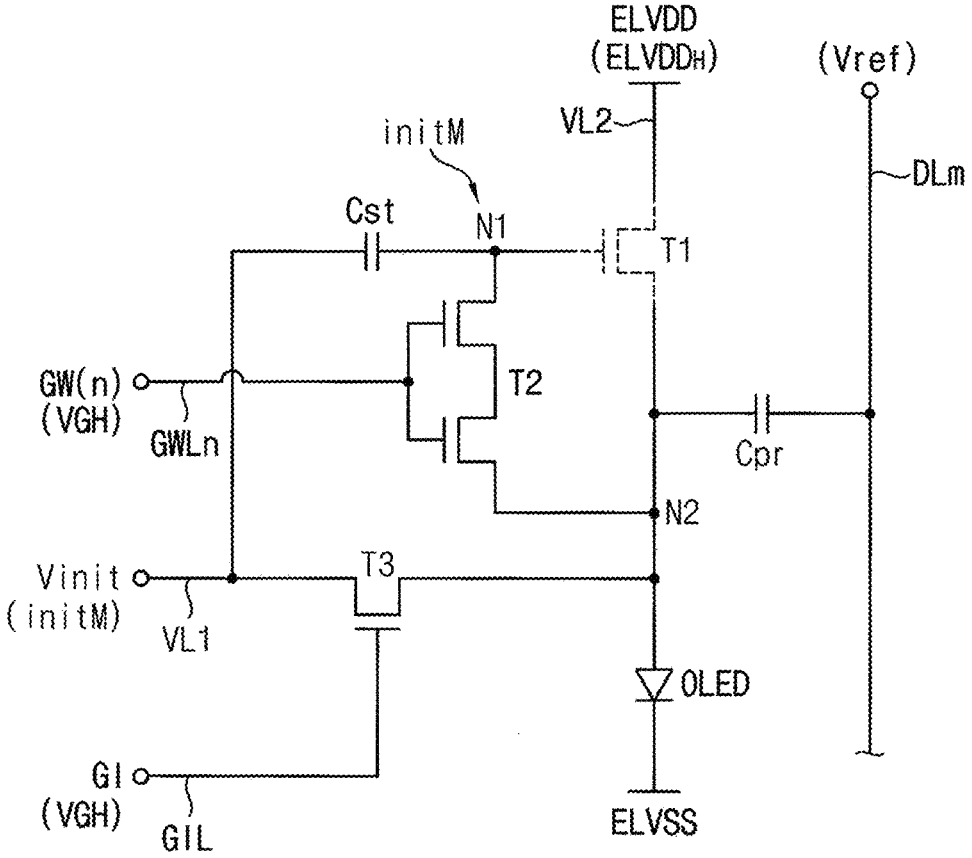
FIG. 4 is a conceptual diagram illustrating an operation of a pixel circuit in an initializing period in FIG. 3.

FIG. 4 is a conceptual diagram illustrating an operation of a pixel circuit in an initializing period in FIG. 3.

Referring to FIGS. 3 and 4, the first period 'a' corresponds to an initializing period in which the anode electrode of organic light emitting diode OLED is initialized. Here, a transistor illustrated with broken lines means that the transistor is in a turned-off state.

In the first period 'a', the middle voltage initM of the initial driving signal Vinit is applied to the first voltage line VL1, the high voltage VGH of the initial controlling signal GI is applied to the third voltage line GIL, and the high voltage ELVDDH of the first power source signal ELVDD is applied to the second voltage line VL2. The n-th gate line GWLn receives the high voltage VGH of the n-th gate signal GW(n). The m-th data line DLm receives the reference voltage Vref.

Referring to a method of driving the pixel circuit PC, the middle voltage initM of the initial driving signal Vinit is applied to the first node N1. The second transistor T2 is turned on in response to the high voltage VGH of the n-th gate signal GW(n), and then the middle voltage initM of the initial driving signal Vinit applied to the first node N1 is provided to the second node N2.

The third transistor T3 is turned on in response to the high voltage VGH of the initial controlling signal GI, and then the middle voltage initM of the initial driving signal Vinit is provided to the second node N2. The anode electrode of the organic light emitting diode OLED connected to the second node N2 may be initialized by the middle voltage initM of the initial driving signal Vinit. In an exemplary embodiment, for example, the middle voltage initM of the initial driving signal Vinit may be predetermined to about −2.2 V.

Therefore, during the first period 'a', the organic light emitting diode OLED may be initialized.

Figure 5:
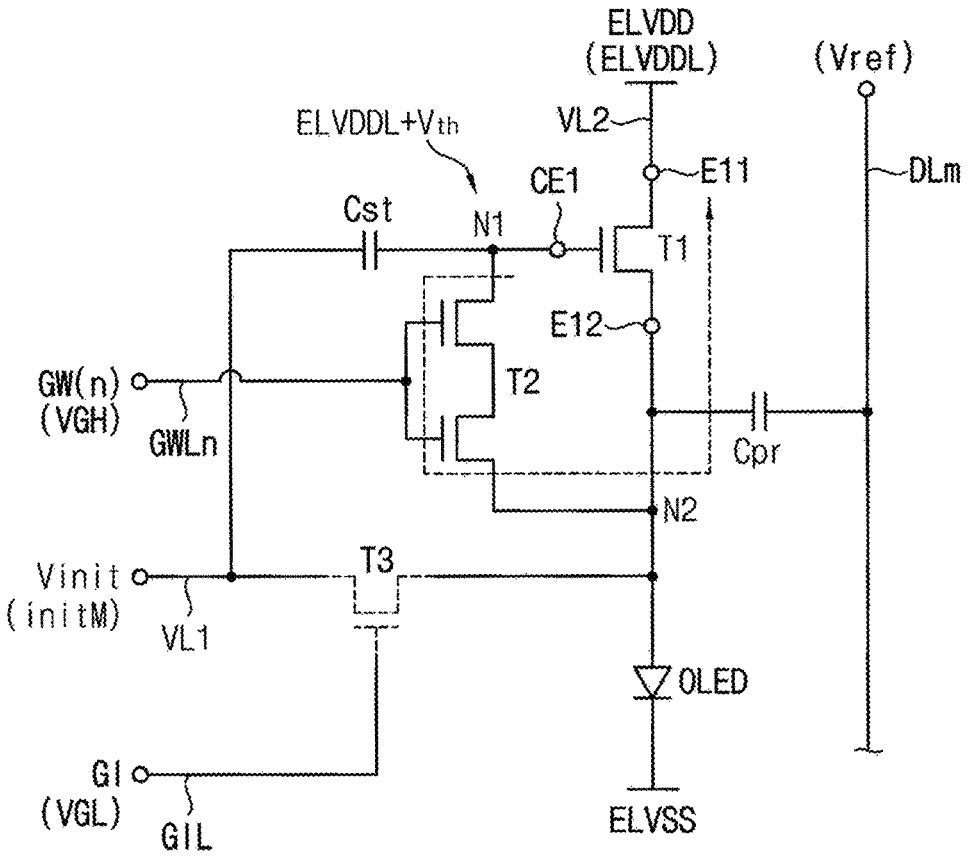
FIG. 5 is a conceptual diagram illustrating an operation of a pixel circuit in a compensating period in FIG. 3.

FIG. 5 is a conceptual diagram illustrating an operation of a pixel circuit in a compensating period in FIG. 3.

Referring to FIGS. 3 and 5, the second period 'b' may correspond to a compensating period during which the threshold voltage of the first transistor T1 is compensated.

In the second period 'b', the middle voltage initM of the initial driving signal Vinit is applied to the first voltage line VL1, the low voltage VGL of the initial controlling signal GI is applied to the third voltage line GIL, the low voltage ELVDDL of the first power source signal ELVDD is applied to the second voltage line VL2. The n-th gate line GWLn receives the high voltage VGH of the n-th gate signal GW(n). The m-th data line receives the reference voltage Vref.

Referring to the method of driving the pixel circuit PC, the middle voltage initM of the initial driving signal Vinit is applied to the first node N1. The second transistor T2 is turned on in response to the high voltage VGH of the n-th gate signal GW(n), and then the middle voltage initM of the initial driving signal Vinit applied to the first node N1 is provided to the second node N2. The third transistor T3 is turned off in response to the low voltage VGL of the initial controlling signal GI.

When the second transistor T2 turns on, the control electrode CE1 and the second electrode E12 of the first transistor T1 are connected to each other and the low voltage ELVDDL of the first power source signal ELVDD is applied to the first electrode E11 of the first transistor T1.

The first electrode E11 of the first transistor T1 receives the low voltage ELVDDL of the first power source signal ELVDD. The first electrode E11 of the first transistor T1 that is the N-type transistor is driven as a drain (i.e., drain electrode), and the second electrode E12 of the first transistor T1 that is the N-type transistor is driven as a source (i.e., source electrode).

Therefore, when the second transistor T2 is turned on, the gate and source of the first transistor T1 are connected to each other and then the first transistor T1 is diode-coupled.

When the first transistor T1 is diode-coupled, the first node N1 connected to the control electrode CE1 of the first transistor T1 receives the threshold compensation voltage ELVDDL+Vth corresponding to a sum of the low voltage ELVDDL of the first power source signal ELVDD and the threshold voltage Vth of the first transistor T1.

Figure 6:
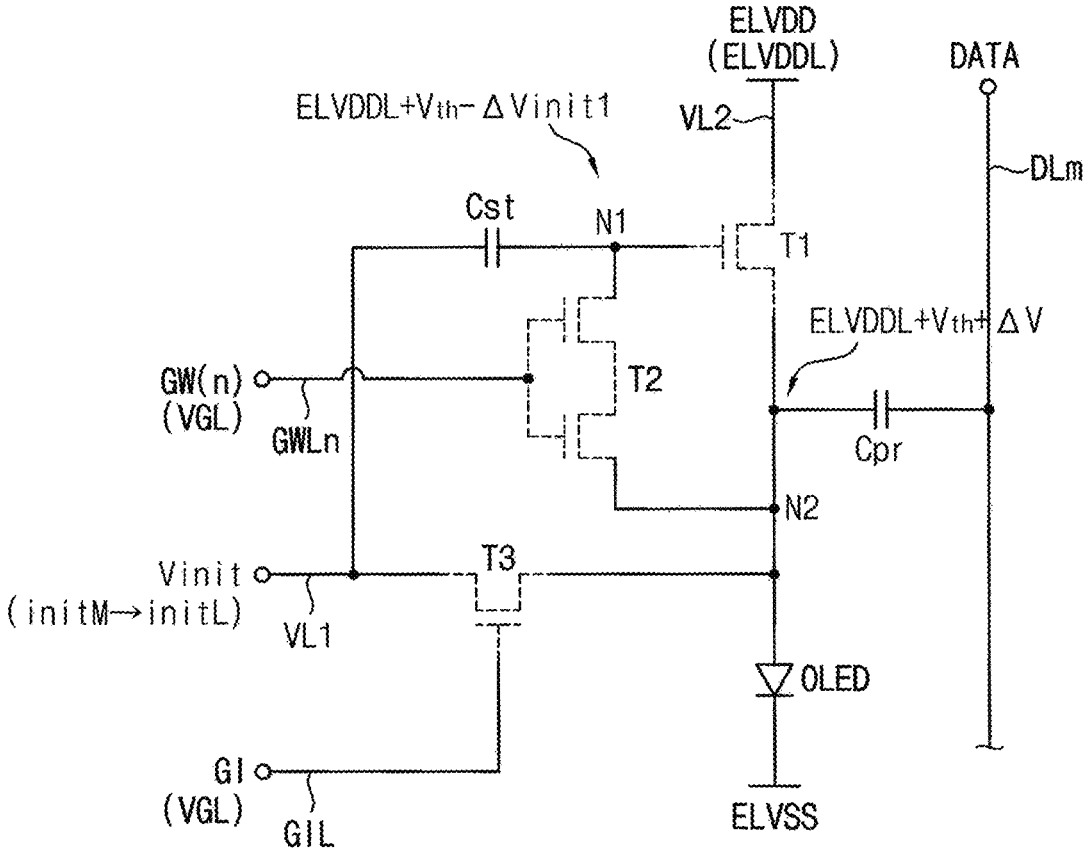
FIG. 6 is a conceptual diagram illustrating an operation of a pixel circuit in a ripple-controlling period in FIG. 3.

FIG. 6 is a conceptual diagram illustrating an operation of a pixel circuit in a ripple-controlling period in FIG. 3.

Referring to FIGS. 3 and 6, the third period 'c' may correspond to a ripple-controlling period during which a ripple voltage of the first node N1 connected to the control electrode of the first transistor T1 is controlled.

In the third period 'c', the first voltage line VL1 receives the initial driving signal Vinit which swings from the middle voltage initM to the low voltage initL. The second voltage line VL2 receives the low voltage ELVDDL of the first power source signal ELVDD, and the third voltage line GIL receives the low voltage VGL of the initial controlling signal GI. The n-th gate line GWLn receives the low voltage VGL of the n-th gate signal GW(n), and the m-th data line DLm receives the reference voltage Vref.

Referring to the early period 'c1' of the third period 'c', a first ripple occurs at the initial driving signal Vinit by coupling with the n-th gate signal GW(n) when the n-th gate signal GW(n) is dropped from the high voltage VGH to low voltage VGL. Thus, a second ripple occurs at a voltage applied to the first node N1 by the first ripple of the initial driving signal Vinit.

In the latter period 'c2' of the third period 'c', the low voltage initL lower than the middle voltage initM of the initial driving signal Vinit is applied to the first voltage line VL1, and thus the voltage Vg applied to the first node N1 may be dropped to a dropped voltage lower than the threshold compensation voltage ELVDDL+Vth. The dropped voltage ELVDDL+Vth−ΔVinit1 may be a voltage less than the threshold compensation voltage ELVDDL+Vth by a voltage difference ΔVinit1, where the voltage difference ΔVinit1 is a voltage difference between the middle voltage initM and the low voltage initL. The voltage Vg of the first node N1 may be maintained to be lower than the voltage Vs applied to the second node N2. The gate/source voltage of the first transistor T1 may be predetermined to be lower than 0V.

Therefore, during the first holding period 'd1' of the fourth period 'd', the gate/source voltage of the first transistor T1 may be maintained to be lower than 0V, and thus the leakage current of the first transistor T1 may be avoided.

Figure 7:
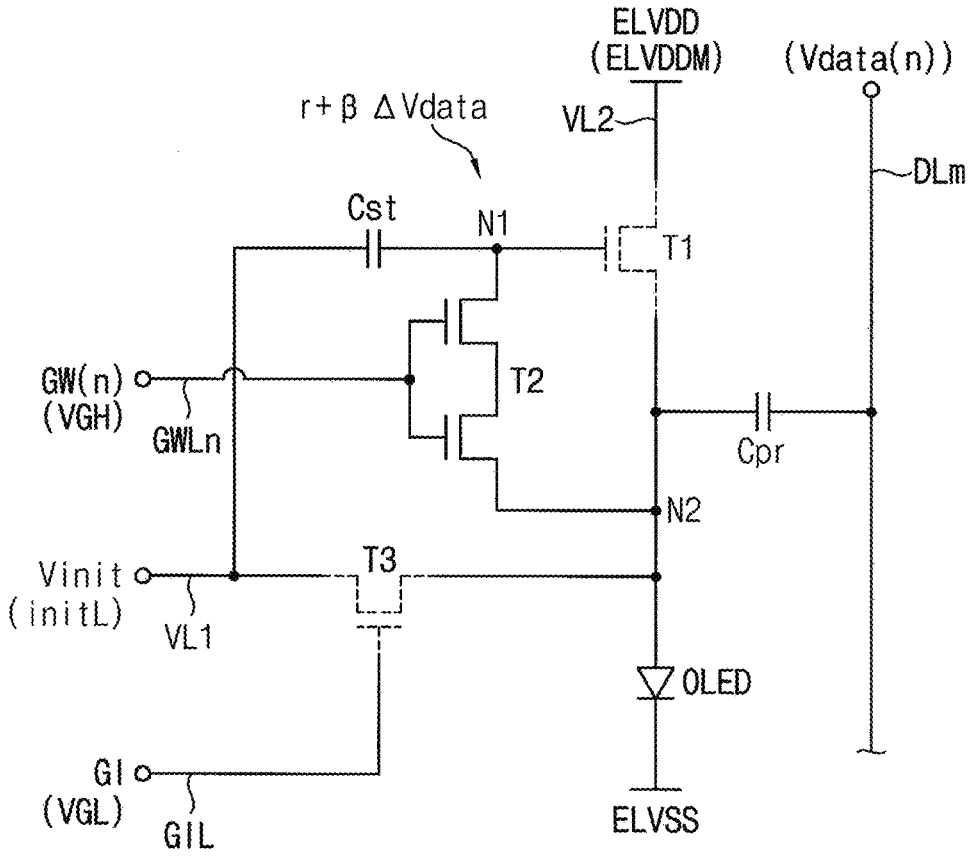
FIG. 7 is a conceptual diagram illustrating an operation of a pixel circuit in a data-programming period in FIG. 3.

FIG. 7 is a conceptual diagram illustrating an operation of a pixel circuit in a data-programming period in FIG. 3.

Referring to FIGS. 3 and 7, the fourth period may correspond to a data-programming period during which the data voltage DATA is applied to the plurality of pixels.

The fourth period may include a first holding period 'd1', a writing period 'd2' and a second holding period 'd2'.

During the first holding period 'd1', the first voltage line VL1 receives the low voltage initL of the initial driving signal Vinit, the second voltage line VL2 receives the middle voltage ELVDDM of the first power source signal ELVDD, and the third voltage line GIL receives the low voltage VGL of the initial controlling signal GI. The n-th gate line GWLn receives the low voltage VGL of the n-th gate signal GW(n), and the m-th data line DLm receives previous data voltages Vdata(1), . . . , Vdata(n−1) corresponding to previous rows of pixels.

The first transistor T1 is turned off in response to the voltage of the first node N1, and the second and third transistors T2 and T3 are turned off in response to the low voltage VGL.

During the first holding period 'd1', the voltage Vs of the second node N2 connected to the anode electrode of the organic light emitting diode OLED may have a changed voltage ELVDD_L+Vth+ΔV affected by changes of the previous data voltages Vdata(1), . . . , Vdata(n−1), where ΔV is the changed amount affected by changes of the previous data voltages Vdata(1), . . . , Vdata(n−1).

The voltage Vg of the first node N1 may be maintained to be a voltage ELVDDL+Vth−ΔVinit1 lower than the changed voltage ELVDD_L+Vth+ΔV by the low voltage initL of the initial driving signal Vinit which is applied in the third period 'c'. During the first holding period 'd1', the gate/source voltage of the first transistor T1 may be maintained to be lower than 0V and thus, the leakage current of the first transistor T1 may be avoided.

In addition, the second voltage line VL2 receives the middle voltage ELVDDM lower than the high voltage ELVDDH of the first power source signal ELVDD, and thus, a drain/source voltage (i.e., voltage difference between the source voltage and the drain voltage) of the first transistor T1 may be decreased. Therefore, the leakage current of the first transistor T1 may be decreased.

During the writing period d2, the first voltage line VL1 receives the low voltage initL of the initial driving signal Vinit. The second voltage line VL2 receives the middle voltage ELVDDM of the first power source signal ELVDD. The third voltage line GIL receives the low voltage VGL of the initial controlling signal GI. The n-th gate line GWLn receives the high voltage VGH of the n-th gate signal GW(n). The plurality of data lines DL1, . . . , DLm, . . . , DLM receives the data voltage Vdata(n) corresponding to the n-th row of pixels.

The m-th data line DLm receives the data voltage Vdata(n) of the pixel circuit PC in the n-th row of pixels.

Referring to the method of driving the pixel circuit PC, the low voltage initL of the initial driving signal Vinit is applied to the first node N1. The first transistor T1 which is connected to the first node N1 is turned off. The third transistor T3 is turned off by the low voltage VGL of the initial controlling signal GI.

The second transistor T2 is turned on in response to the high voltage VGH of the n-th gate signal GW(n) and then the first node N1 is connected to the second node N2. The first capacitor Cst is connected to the second capacitor Cpr in series through the second transistor T2 turned on.

The m-th data line DLm receives the n-th data voltage Vdata(n) corresponding to the pixel circuit PC. A voltage difference ΔVdata between the n-th data voltage Vdata(n) and the reference voltage Vref is applied to the m-th data line DLm.

The first and second capacitors Cst and Cpr which are connected in series has a voltage division ratio β corresponding to the first node N1 which is a node connecting the first capacitor Cst and the second capacitor Cpr. Values of the voltage division ratio β and the difference voltage ΔVdata may be calculated by the following Equations 1. For convenience, in equations 1 and 2, the reference characters representing the capacitors are also used to represent capacitance values of the corresponding capacitors, respectively.

$$\beta = Cpr/(Cst+Cpr),$$

$$\Delta V_{data} = V_{data(n)} - V_{ref} \qquad \text{Equations 1}$$

Therefore, the voltage difference ΔVdata is divided by the voltage division ratio β of the first and second capacitors Cst and Cpr, and divided voltage β ΔVdata having a value of the product of β and ΔVdata is applied to the first node N1.

Therefore, a voltage defined as the following Equation 2 may be applied to the first node N1 during the n-th horizontal period (i.e., a period during which the high voltage VGH of the n-th gate signal GW(n) is provided among the fourth period 'd').

$$\gamma + \beta \Delta V_{data}, \qquad \text{Equation 2}$$

where γ=[(ELVDDL+Vth−ΔVinit1)Cst+Vref(Cpr+Cel)]/(Cst+Cpr+Cel).

In Equation 2, 'Cel' is a capacitance of a parasitic capacitor of the organic light emitting diode OLED.

Then, during the third holding period d3, the n-th gate line GWLn receives the low voltage VGL of the n-th gate signal GW(n), and the third voltage line GIL receives the low voltage VGL of the initial controlling signal GI.

The first and second transistors T1 and T2 are turned off in response to the low voltage VGL and the divided data voltage applied to the first node N1 may be maintained by the first capacitor Cst.

Figure 8:
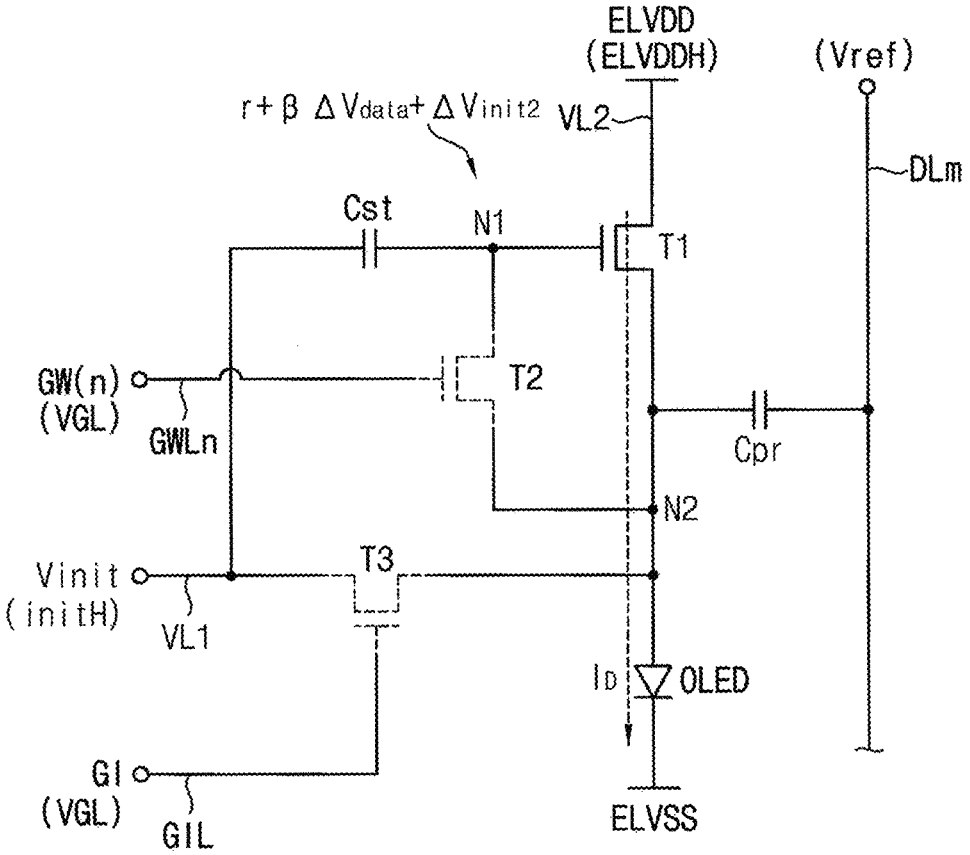
FIG. 8 is a conceptual diagram illustrating an operation of a pixel circuit in a light-emitting period in FIG. 3.

FIG. 8 is a conceptual diagram illustrating an operation of a pixel circuit in a light-emitting period in FIG. 3.

Referring to FIGS. 3 and 8, the fifth period 'e' may correspond to a light-emitting period during which the organic light emitting diode OLED emits the light.

Referring to the fourth period 'e', the first voltage line VL1 receives the high voltage initH of the initial driving signal Vinit, the second voltage line VL2 receives the high voltage ELVDDH of the first power source signal ELVDD, the third voltage line GIL receives the low voltage VGL of the initial controlling signal GI, and the n-th gate line GWLn receives the low voltage VGL of the n-th gate signal GW(n). The m-th data line DLm receives the reference voltage Vref.

Referring to the method of driving the pixel circuit PC, the high voltage initH of the initial driving signal Vinit is added to the first node N1 and thus, a voltage defined as the following Equation 3 may be applied to the first node N1 as a result.

$$\gamma+\beta\Delta V_{data}+\Delta V\text{init2} \qquad \text{Equation 3}$$

In Equation 3, a voltage difference ΔVinit2 represents a voltage difference between the high and low voltages initH and initL of the initial driving signal Vinit.

When the voltage defined as the following Equation 3 is applied to the control electrode CE1 of the first transistor T1, the first transistor T1 is turned on based on the voltage difference ΔVinit2.

The second transistor T2 is turned off in response to the low voltage VGL of the n-th gate signal GW(n) and the third transistor T3 is turned off in response to the low voltage VGL of the initial controlling signal GI.

Therefore, the first transistor T1 is turned on and thus, a driving current ID corresponding to the data voltage may flow through the organic light emitting diode OLED. The organic light emitting diode OLED may emit the light.

Figure 9:
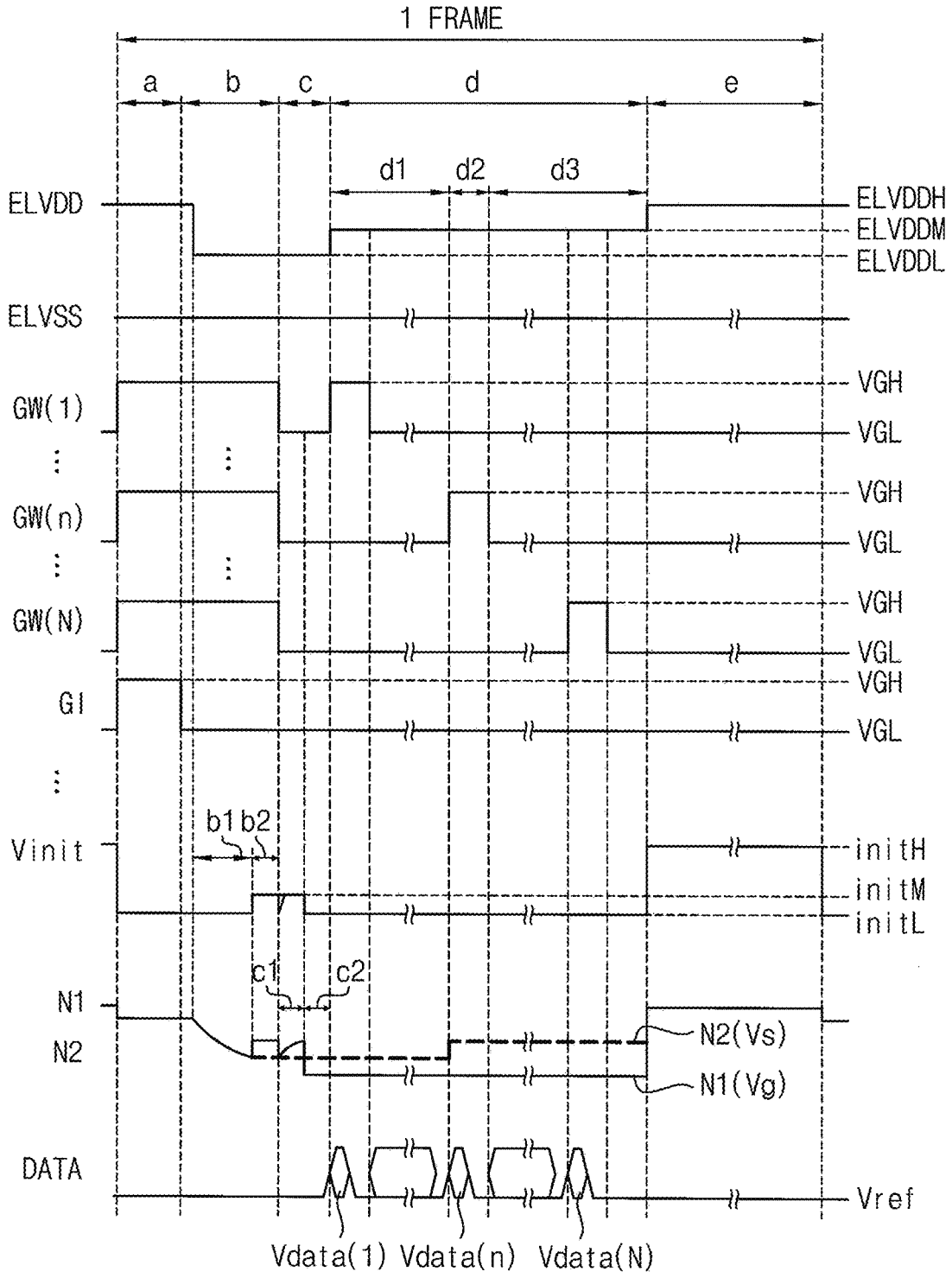
FIG. 9 is a waveform diagram illustrating another exemplary embodiment of a method of driving a pixel circuit according to the invention.
Figure 10:
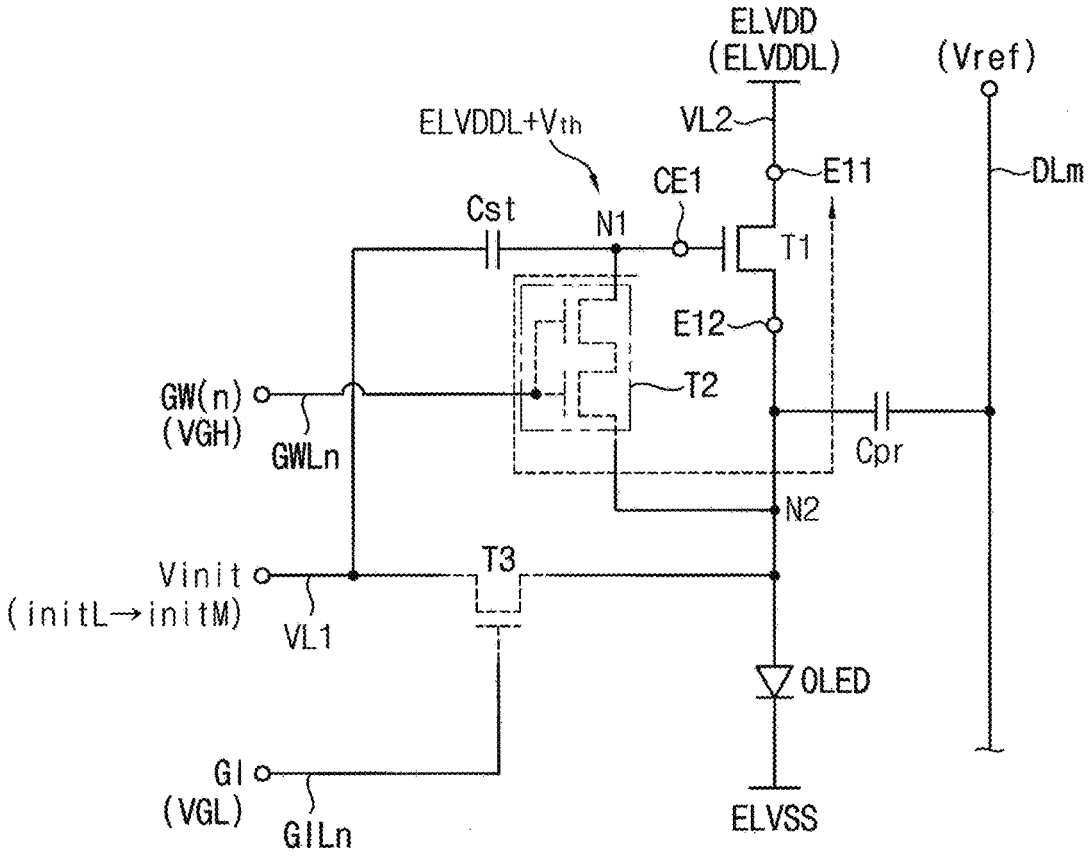
FIG. 10 is a conceptual diagram illustrating an operation of a pixel circuit in a compensating period in FIG. 9.
Figure 11:
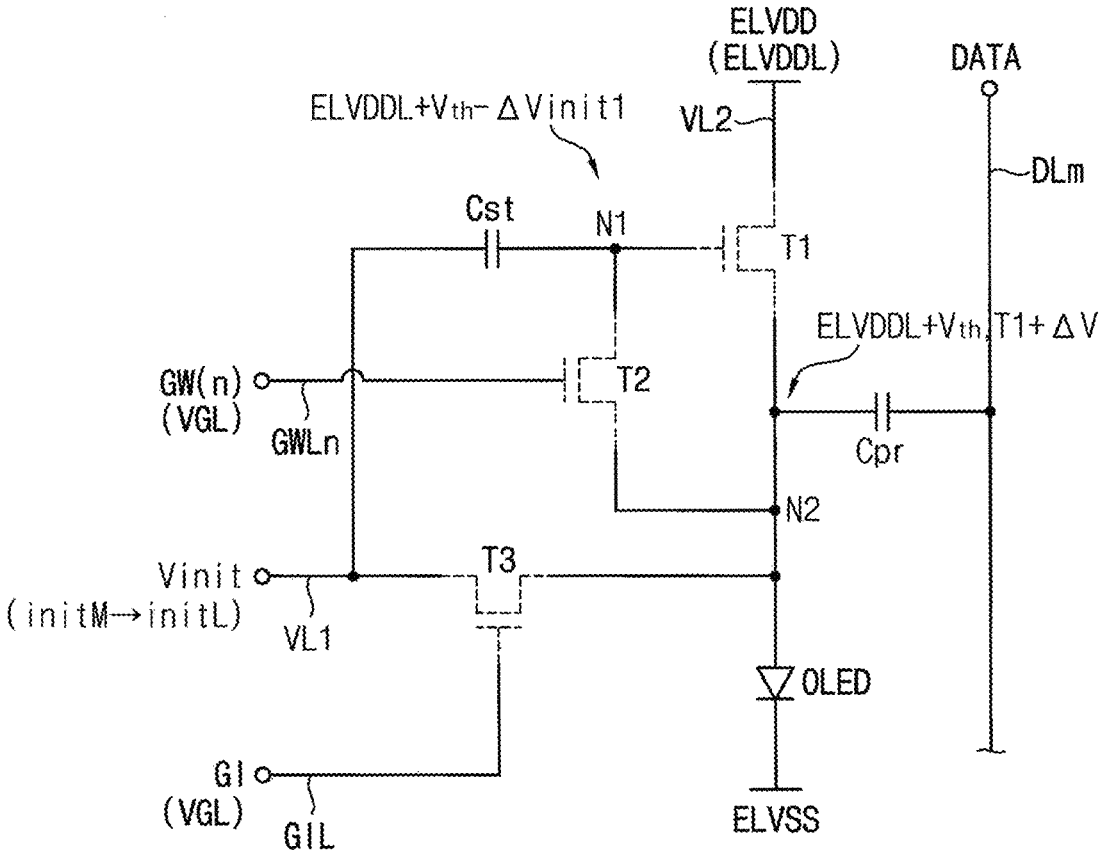
FIG. 11 is a conceptual diagram illustrating an operation of a pixel circuit in a ripple-controlling period in FIG. 9.

FIG. 9 is a waveform diagram illustrating another exemplary embodiment of a method of driving a pixel circuit according to the invention. FIG. 10 is a conceptual diagram illustrating an operation of a pixel circuit in a compensating period in FIG. 9. FIG. 11 is a conceptual diagram illustrating an operation of a pixel circuit in a ripple-controlling period in FIG. 9.

According to an exemplary embodiment, the initial driving signal Vinit may have the high voltage initH, the middle voltage initM and the low voltage initL. The high voltage initH, the middle voltage initM and the low voltage initL of the initial driving signal Vinit may have such relationships as initH>initM>0>initL.

Referring to FIG. 9, the frame period may include a first period 'a' during which an anode electrode of an organic light emitting diode is initialized, a second period 'b' during which a threshold voltage of a first transistor T1 is compensated, a third period 'c' during which a ripple of the first node N1 is controlled, a fourth period 'd' during which a data voltage is applied to a pixel circuit and a fifth period 'e' during which the organic light emitting diode emits light.

A method of driving a pixel circuit according to the exemplary embodiment may be the same as those described in the previous exemplary embodiments except for a waveform diagram of the initial driving signal Vinit, and the same detailed explanations are not repeated unless necessary.

During the first period 'a', the first voltage line VL1 receives the low voltage initL of the initial driving signal Vinit. In an exemplary embodiment, for example, the low voltage initL of the initial driving signal Vinit may be predetermined to be lower than about −6 V. During the first period 'a', the anode electrode of the organic light emitting diode OLED may be initialized by the low voltage initL of the initial driving signal Vinit.

Referring to FIGS. 9 and 10, the second period 'b' may include an early period 'b1' and a latter period 'b2'. The first voltage line VL1 receives the low voltage initL of the initial driving signal Vinit during the early period 'b1' and receives the middle voltage initM of the initial driving signal Vinit during the latter period 'b2'.

According to an exemplary embodiment, the middle voltage initM of the initial driving signal Vinit may be predetermined to about 1 V to 5 V.

Referring to FIGS. 9 and 11, the third period 'c' may include an early period 'c1' and a latter period 'c2'. The first voltage line VL1 receives the middle voltage initM of the initial driving signal Vinit during the early period 'c1' and the low voltage initL of the initial driving signal Vinit during the latter period 'c2'.

In the early period 'c1', a first ripple occurs at the initial driving signal Vinit by coupling with the n-th gate signal GW(n) when the n-th gate signal GW(n) is dropped from the high voltage VGH to the low voltage VGL. Thus, a second ripple occurs at a voltage applied to the first node N1 by the first ripple of the initial driving signal Vinit.

In the latter period 'c2', the low voltage initL lower than the middle voltage initM of the initial driving signal Vinit is applied to the first voltage line VL1, and thus the voltage Vg applied to the first node N1 may be dropped to a dropped voltage lower than a threshold compensation voltage ELVDDL+Vth. The dropped voltage ELVDDL+Vth−ΔVinit1 may be a difference between the threshold compensation voltage ELVDDL+Vth and the voltage difference ΔVinit1, where the voltage difference ΔVinit1 may be a difference between the middle voltage initM and the low voltage initL. The voltage Vg of the first node N1 may be maintained to be lower than the voltage Vs applied to the second node N2. The gate/source voltage of the first transistor T1 may be predetermined to be lower than 0V.

Therefore, during the first holding period 'd1' of the fourth period 'd', the gate/source voltage of the first transistor T1 may be maintained to be lower than 0V, and thus the leakage current of the first transistor T1 may be avoided.

Figure 12:
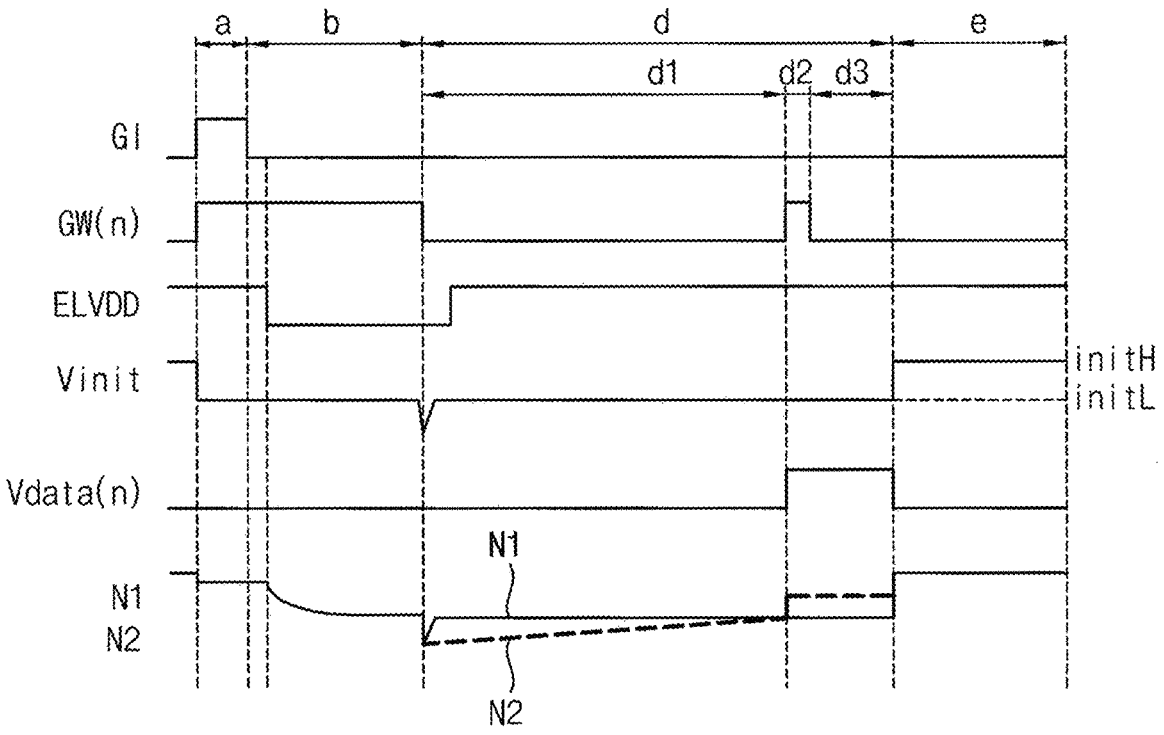
FIG. 12 is a waveform diagram illustrating a method of driving a pixel circuit according to a comparative exemplary embodiment.

FIG. 12 is a waveform diagram illustrating a method of driving a pixel circuit according to a comparative exemplary embodiment.

Referring to FIG. 12, according to the comparative exemplary embodiment, the frame period may include a first period 'a' during which an anode electrode of an organic light emitting diode is initialized, a second period 'b' during which a threshold voltage of a first transistor T1 is compensated, a fourth period during which a data voltage is applied to a pixel circuit and a fifth period 'e' during which the organic light emitting diode emits light.

Referring to an early stage of the fourth period according to the comparative exemplary embodiment, a ripple occurs at the initial driving signal Vinit by coupling with the n-th gate signal GW(n) when the n-th gate signal GW(n) is dropped from the high voltage VGH to the low voltage VGL. The voltage applied to the first node N1 is instantaneously dropped and then gradually swings upward by the ripple of the initial driving signal Vinit.

The voltage applied to the first node N1 is restored during the first holding period 'd1' before the writing period d2 of the data-programming period during which the data voltage Vdata(n) is applied to corresponding pixel circuit.

As shown in FIG. 12, during the first holding period 'd1', the voltage applied to the first node N1 is higher than the voltage applied to the second node N2. The gate/source voltage of the first transistor T1 is higher than 0V and thus, the leakage current of the first transistor T1 occurs.

As described above, the display defects such as the crosstalk occur by the leakage current of the first transistor in the first holding period 'd1'.

According to some exemplary embodiments, in a period between the compensating period and the data-programming period, the ripple of the transistor is controlled by the initial driving signal which swings from the middle voltage to the low voltage and thus, the display defects such as the crosstalk may be avoided.

According to some exemplary embodiments, in the pixel circuit including the organic light emitting diode, three transistors and two capacitors which drive the organic light emitting diode, the ripple of the transistor is controlled and thus the display defects such as the crosstalk by the ripple of the transistor may be avoided.

The inventive concept may be applied to a display device and an electronic device having the display device. For example, the inventive concept may be applied to a computer monitor, a laptop, a digital camera, a cellular phone, a smart phone, a smart pad, a television, a personal digital assistant ("PDA"), a portable multimedia player ("PMP"), a MP3 player, a navigation system, a game console, a video phone, etc.

The foregoing is illustrative of the inventive concept and is not to be construed as limiting thereof. Although a few exemplary embodiments of the inventive concept have been described, those skilled in the art will readily appreciate that many modifications are possible in the exemplary embodiments without materially departing from the novel teachings and advantages of the inventive concept. Accordingly, all such modifications are intended to be included within the scope of the inventive concept as defined in the claims. In the claims, means-plus-function clauses are intended to cover the structures described herein as performing the recited function and not only structural equivalents but also equivalent structures. Therefore, it is to be understood that the foregoing is illustrative of the inventive concept and is not to be construed as limited to the specific exemplary embodiments disclosed, and that modifications to the disclosed exemplary embodiments, as well as other exemplary embodiments, are intended to be included within the scope of the appended claims. The inventive concept is defined by the following claims, with equivalents of the claims to be included therein.

What is claimed is:

1. A display apparatus comprising:

a gate driver which sequentially outputs a plurality of gate signals to a plurality of gate lines;

a display part comprising a pixel which comprises:

a first capacitor connected between a first voltage line receiving an initialization driving signal and a first node, a first transistor which comprises a control electrode connected to the first node, a first electrode connected to a second voltage line receiving a first power source signal and a second electrode connected to a second node, an organic light emitting diode which comprises an anode electrode connected to the second node and a cathode electrode receiving a second power source signal, a second capacitor connected between a data line and the second node, a second transistor which comprises a control electrode connected to an n-th gate line of the plurality of gate lines, a first electrode connected to the first node and a second electrode connected to the second node, wherein 'n' is a natural number, and a third transistor which comprises a control electrode connected to a third voltage line receiving an initialization controlling signal, a first electrode connected to the first voltage line and a second electrode connected to the second node; and a voltage generator which generates the initialization driving signal which comprises a high voltage, a middle voltage and a low voltage, wherein the initialization driving signal swings from the middle voltage to the low voltage thereof after the plurality of gate signals is simultaneously dropped from a high voltage to a low voltage of the plurality of gate signals.

2. The display apparatus of claim 1, wherein during a first period of a frame period, the first voltage line receives the middle voltage of the initialization driving signal, the second voltage line receives a high voltage of the first power source signal, the plurality of gate lines simultaneously receives the high voltage of the plurality of gate signals and the third voltage line receives a high voltage of the initialization controlling signal.

3. The display apparatus of claim 2, wherein during a second period of the frame period, the first voltage line receives the middle voltage of the initialization driving signal, the second voltage line receives a low voltage of the first power source signal, the plurality of gate lines simultaneously receives the high voltage of the plurality of gate signals and the third voltage line receives a low voltage of the initialization controlling signal.

4. The display apparatus of claim 3, wherein during a third period of the frame period, the first voltage line receives the initialization driving signal swinging from the middle voltage to the low voltage thereof, the second voltage line receives the low voltage of the first power source signal, the plurality of gate lines simultaneously receives the low voltage of the plurality of gate signals and the third voltage line receives the low voltage of the initialization controlling signal.

5. The display apparatus of claim 4, wherein the high voltage of the initialization driving signal has a positive voltage, and the middle and low voltages of the initialization driving signal have negative voltages.

6. The display apparatus of claim 1, wherein during a first period of a frame period, the first voltage line receives the low voltage of the initialization driving signal, the second voltage line receives a high voltage of the first power source signal, the plurality of gate lines simultaneously receives the high voltage of the plurality of gate signals and the third voltage line receives a high voltage of the initialization controlling signal.

7. The display apparatus of claim 6, wherein during a second period of the frame period, the first voltage line receives the initialization driving signal swinging from the low voltage to the middle voltage thereof, the second voltage line receives a low voltage of the first power source signal, the plurality of gate lines simultaneously receives the high voltage of the plurality of gate signals and the third voltage line receives a low voltage of the initialization controlling signal.

8. The display apparatus of claim 7, wherein during a third period of the frame period, the first voltage line receives the initialization driving signal swinging from the middle voltage to the low voltage thereof, the second voltage line receives the low voltage of the first power source signal, the plurality of gate lines simultaneously receives a low voltage of the plurality of gate signals and the third voltage line receives the low voltage of the initialization controlling signal.

9. The display apparatus of claim 8, wherein the high and middle voltages of the initialization driving signal have positive voltages and the low voltage of the initialization driving signal has a negative voltage.

10. The display apparatus of claim 1, wherein the low voltage of the initialization driving signal is about −6 V.

11. The display apparatus of claim 1, wherein during a fourth period of the frame period, the first voltage line receives the low voltage of the initialization driving signal, the n-th gate line receives the high voltage of an n-th gate signal of the plurality of gate signals, the third voltage line receives the low voltage of the initialization controlling signal and the data line receives a data voltage corresponding to the pixel.

12. The display apparatus of claim 11, wherein during a period when the n-th gate line receives the high voltage of the n-th gate signal, the first and second capacitors are connected to each other in series, the data voltage is divided by the first and second capacitors and a divided voltage of the data voltage is applied to the first node.

13. The display apparatus of claim 11, wherein during the fourth period of the frame period, the second voltage line receives a middle voltage between the high voltage and the low voltage of the first power source signal.

14. The display apparatus of claim 1, wherein during a fifth period of the frame period, the first voltage line receives the high voltage of the initialization driving signal, the second voltage line receives a high voltage of the first power source signal, the third voltage line receives a low voltage of the initialization controlling signal, the plurality of gate lines simultaneously receives the low voltage of the plurality of gate signals, and a driving current corresponding to a divided voltage, applied to the first node, of a data voltage provided from the data line during a fourth period of the frame period flows through the organic light emitting diode.

15. A method of driving a display apparatus comprising a pixel which comprises a first capacitor connected between a first voltage line receiving an initialization driving signal and a first node, a first transistor which comprises a control electrode connected to the first node, a first electrode connected to a second voltage line receiving a first power source signal and a second electrode connected to a second node, an organic light emitting diode which comprises an anode electrode connected to the second node and a cathode electrode receiving a second power source signal, a second capacitor connected between a data line and the second node, a second transistor which comprises a control electrode connected to an n-th gate line of a plurality of gate lines, a first electrode connected to the first node and a second electrode connected to the second node, and a third transistor which comprises a control electrode connected to a third voltage line receiving an initialization controlling signal, a first electrode connected to the first voltage line and a second electrode connected to the second node, wherein 'n' is a natural number, the method comprising:

(a) generating an initial driving signal comprising one of a high voltage, a middle voltage and a low voltage at once;

(b) initializing the anode electrode of the organic light emitting diode connected to the second electrode of the first transistor using the initial driving signal received from the first voltage line;

(c) applying a low voltage of the first power source signal to the first electrode of the first transistor such that the first transistor is diode-coupled and a threshold voltage of the first transistor is compensated;

(d) receiving the initial driving signal which swings from the middle voltage of the initial driving signal to the low voltage of the initial driving signal after a plurality of gate signals applied to the plurality of gate lines is simultaneously dropped from the high voltage of the initial driving signal to the low voltage of the initial driving signal thereof, (e) applying a voltage divided by the first and second capacitors from a data voltage received through the data line to the first node during a period when only the n-th gate line of the plurality of gate lines receives a high voltage of the plurality of gate signals; and (f) emitting light by the organic light emitting diode based on the divided voltage applied to the first node in response to the initial driving signal received from the first voltage line.

16. The method of claim 15, wherein the first voltage line receives the middle voltage of the initial driving signal in initializing the anode electrode of the organic light emitting diode and applying the low voltage of the first power source signal, the low voltage of the initial driving signal in applying the voltage divided by the first and second capacitors, and the high voltage of the initial driving signal in emitting light by the organic light emitting diode.

17. The method of claim 16, wherein the high voltage of the initial driving signal has a positive voltage, and the middle and low voltages of the initial driving signal have negative voltages.

18. The method of claim 15, wherein the first voltage line receives the low voltage of the initial driving signal in initializing the anode electrode of the organic light emitting diode and applying the voltage divided by the first and second capacitors, and the high voltage of the initial driving signal in emitting light by the organic light emitting diode.

19. The method of claim 18, wherein the high and middle voltages of the initial driving signal have positive voltages and the low voltage of the initial driving signal has a negative voltage.

20. The method of claim 15, wherein the second voltage line receives a high voltage of the first power source signal in initializing the anode electrode of the organic light emitting diode and emitting light by the organic light emitting diode, the low voltage of the first power source signal in applying the low voltage of the first power source signal and receiving the initial driving signal, and a middle voltage of the first power source signal between the high and low voltages of the first power source signal in applying the voltage divided by the first and second capacitors.

* * * * *